US006262526B1

(12) United States Patent
Miyazawa et al.

(10) Patent No.: US 6,262,526 B1
(45) **Date of Patent: *Jul. 17, 2001**

(54) COLOR BRAUN TUBE

(75) Inventors: Hiroshi Miyazawa, Hitachi; Makoto Koizumi, Ibaraki; Mutsumi Maehara; Hidetoshi Kida, both of Mobara, all of (JP)

(73) Assignee: Hitachi, LTD, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/492,525

(22) Filed: Jan. 27, 2000

Related U.S. Application Data

(63) Continuation of application No. 08/714,392, filed on Sep. 16, 1996, now Pat. No. 6,028,392.

(30) Foreign Application Priority Data

Sep. 21, 1995 (JP) ..... 7-243191

(51) Int. Cl.[7] ..... H01J 29/46; H01J 29/50

(52) U.S. Cl. ..... 313/446; 313/409; 313/412; 313/413; 313/414; 445/36

(58) Field of Search ..... 313/409–410, 313/412–14, 421, 426–28, 441, 444, 446, 449–50, 440, 417; 445/36

(56) References Cited

U.S. PATENT DOCUMENTS

| | | | |
|---|---|---|---|
| 4,396,862 | 8/1983 | Hughes . | |
| 4,593,226 | 6/1986 | Naiki . | |
| 4,633,130 | 12/1986 | McCandless . | |
| 4,659,961 | 4/1987 | Naiki . | |
| 4,825,122 | 4/1989 | Kakesu et al. . | |
| 4,877,993 | 10/1989 | Ogasa . | |
| 5,703,430 | 12/1997 | Dekker . | |
| 6,028,392 * | 2/2000 | Miyazawa et al. | 313/446 |

FOREIGN PATENT DOCUMENTS

| | | |
|---|---|---|
| 63-190232 | 8/1988 | (JP) . |
| 4-181637 | 6/1992 | (JP) . |
| 4-249040 | 9/1992 | (JP) . |

* cited by examiner

*Primary Examiner*—Vip Patel
*Assistant Examiner*—Mack Haynes
(74) *Attorney, Agent, or Firm*—Antonelli, Terry, Stout & Kraus, LLP

(57) ABSTRACT

An in-line type color Braun tube having a fluorescent screen and a shield cup at an end of an electron gun, the shield cup including a cylindrical side wall and a bottom having a center electron beam passing hole and two side electron beam passing holes aligned in a horizontal direction. A convergence correcting member including a base and a pair of horizontal plates, the base and horizontal plates being a one piece member, and a bottom member of the base being cross-shaped and including two side electron beam passing holes and a center electron beam passing hole. A pair of horizontal plates sandwiches an electron beam passing through each of the side electron beam passing holes, in a direction vertical to the electron beam. The base is spot-welded to the bottom of the shield cup at an outer side of each of the side electron bottom beam passing holes proximate to a periphery of the bottom of the shield cup or at outer sides of the center electron beam passing hole along a branch of the cross-shaped base of the bottom member.

8 Claims, 8 Drawing Sheets

COLOR BRAUN TUBE

CROSS REFERENCE TO RELATED APPLICATION

This is a continuation of U.S. application Ser. No. 08/714,392, filed Sep. 16, 1996, now U.S. Pat. No. 6,028,392 the subject matter of which is incorporated by reference herein.

BACKGROUND OF THE INVENTION

The present invention relates to a color Braun tube with an in-line type electron gun, which produces a high-definition picture display.

An in-line type color Braun tube may not encounter a severe problem when it is used as a color television picture tube to receive pictures sent by a standard broadcasting method. However, if an in-line type color Braun tube is used as a monitor for a computer, requiring high-definition performance, since many scanning lines have to be produced at a high frequency in such a monitor, a problem occurs in that a large misconvergence is caused between the scanning area, namely, between the image effective area irradiated by the central beam of the three beams aligned in the horizontal direction, and the image effective areas irradiated by the two beams at both sides, during high frequency beam scanning.

A main cause of the problem can be explained as follows. A shield cup electrode, made of a non-magnetic metal for use in an in-line color Braun tube, is composed of a conductive cylindrical side shield wall surrounding the three beams, and a base plate arranged to face the cathode of the tube and in which three beam passing holes are provided. Further, the shield cup electrode is arranged at the end of the electron gun for generating the three beams aligned in the horizontal direction so as to face the fluorescent screen of the tube, in order to shield the beams from the influences of an electrostatic charge accumulated at the inner surface of the glass bulb of the tube. A deflection yoke for generating a deflection field to deflect the beams is arranged on the outside of the glass bulb where the neck of the tube joins the funnel part in the tube, so that a part of the deflection field, nearer to the cathode, passes the side wall of the shield cup electrode. Therefore, eddy currents are induced in the conductive side wall by the momentarily changing deflection field, and the induced eddy currents act to weaken the deflection field generated by the deflection yoke. In the case of a low deflection frequency such as used in the standard broadcasting method, the influence of the eddy currents on the deflection field is negligible, since the misconvergence is small, even if the image effective area irradiated by the central beam and by both side beams do not converge into one area. On the other hand, in a display tube with high-definition performance of the type used for a monitor of a computer, since the number of scanning lines and the time change rate of the horizontal deflection field are considerably larger than those of a display tube used for a standard broadcasting method, the eddy currents induced in the side wall of the shield cup electrode becomes much larger and remarkably affects the deflection field.

FIG. 11A and FIG. 11B illustrate the structure of a shield cup electrode of an electron gun such as used in the in-line type color Braun tube disclosed in JP-A-190232/1988. As shown in the figures, three beam passing holes 4, 5 and 6 are provided in a horizontal line in a base plate of the shield cup electrode 1 for shielding the beams from the influences of an electrostatic charge accumulated at the surface of the glass bulb of the tube, and the three beams generated by the electron gun are passed through the holes and formed as three horizontally parallel beams. At the upper and lower portions of each of the side holes 4 and 6 of the beam passing holes 4, 5 and 6, a pair of projecting plates 20*a* are provided by bending a pair of rectangular plates projecting from a non-magnetic metal base member 20, so that they project perpendicularly from the base member 20 attached at the base surface 1*b* of the base plate 1*c* in parallel to each other. The non-magnetic metal base member 20, having two pairs of the bent projecting plates 20*a*, is welded at the points 3 between the hole 4 and the hole 5 and between the hole 5 and the hole 6, in an area of the base member 20 disposed between the two pairs of the bent projecting plates, respectively. The two welded points 3 are indicated with a mark x.

Further, JP-A-190232/1988 describes the effects of the above-mentioned structure of the shield cup electrode as follows. That is, the force of the horizontal deflection field is equally applied to each of the three beams aligned in the horizontal direction, due to influences of eddy currents induced in the two pairs of bent projecting plates 20*a* of the non-magnetic metal base member 20. Thus, even with a high frequency deflection field, any misconvergence due to eddy currents flowing in the shield cup electrode is suppressed to a negligible level.

Color Braun tubes having a similar structure are disclosed in JP-A-181637/1992 and JP-A-249040/1992, respectively. In the tube disclosed in JP-A-181637/1992, step-wise members corresponding to the above-mentioned bent projecting plates 20*a* are provided by using annular magnetic field shielding elements made of high-permeability material, and further slits are provided at each of the step-wise members. The use of high-permeability material is effective to shield the beams from the outer magnetic field. Furthermore, the shape of the step-wise members is also effective to suppress eddy currents induced by the high frequency deflection field. In the tube disclosed in JP-A-249040/1992, each of the annular magnetic field shielding elements made of high permeability material, corresponding to the above-mentioned bent projecting plates 20*a*, is accurately positioned by using a circular arc shape projecting rim. Also in this case, the use of high-permeability material is effective to prevent chromatic aberration. Furthermore, the circular arc shape projecting rims are used to suppress eddy currents induced by the high frequency deflection field.

Another cause of the misconvergence between the image effective areas irradiated by the central beam and the two beams on either side can be explained as follows.

That is, a series of non-magnetic metal electrodes forming electron lenses for condensing each of the beams on a fluorescent surface of the tube are arranged between the cathode generating the beams in the tube and the non-magnetic metal shield cup electrode. Since eddy currents induced in the conductive side wall of the shield cup electrode by a changing deflection field generated by the deflection yoke flows into the electron lens forming electrode adjacent the shield cup electrode, eddy currents are consequently generated in a wide region of the shield cup electrode and the electron lens forming electrode adjacent the shield cup electrode. The eddy currents generated in a wide region weaken the deflection field generated by the deflection yoke. As the time change rate of the horizontal deflection field becomes larger, the eddy currents become much larger and more strongly affect the deflecting field. However, a technique for suppressing the misconvergence caused by the eddy currents to an acceptable level, taking also the other above-mentioned cause into account, has not been devised yet.

SUMMARY OF THE INVENTION

An object of the present invention is to provide an in-line type color Braun tube which can effectively suppress any misconvergence of the central beam and both side beams, which is harmful to a high-definition picture display, even if the number of scanning lines and the horizontal deflection frequency are increased in order to realize a high-definition picture display.

A fundamental method to attain the above-mentioned object is to provide an in-line type color Braun tube having a shield cup electrode which is open at the side facing fluorescent screen surface of the tube, provided at the end of an electron gun, the shield cup electrode including:

a structure, in at least one of the shield cup electrode and electrode forming of an electron lens adjacent the shield cup electrode, that suppresses the effects on the electron beams generated by the electron gun of eddy currents induced at the shield cup electrode and the electron lens forming electrode adjacent the shield cup electrode.

More detailed main methods of achieving the above-mentioned object are devised as follows.

The first method is to provide an in-line type color Braun tube having a shield cup electrode which is open at the side facing the fluorescent screen surface of the tube, provided at the end of an electron gun, wherein the shield cup electrode comprises a cylindrical side wall for shielding the three electron beams generated by the electron gun from influences of the electrostatic charge accumulated at a wall surface of the glass bulb of the tube, a base plate having three beam passing holes aligned in a horizontal direction, and two cylinders made of non-magnetic and conductive material for suppressing eddy currents induced at the shield cup electrode, each of the two cylinders surrounding one of the two paths of electron beams passing through the side holes of the three beam passing holes projecting from the base plate in the direction facing the fluorescent surface.

The second method is to provide an in-line type color Braun tube according to the tube provided by the first method, wherein the two cylinders for suppressing eddy currents are projecting in a direction perpendicular to the base plate.

The third method is to provide an in-line type color Braun tube according to the tube provided by the first method, wherein the shield cup electrode and the electron lens forming electrode adjacent the shield cup electrode are separated so that a gap is provided between the shield cup electrode and the electron lens forming electrode which prevents eddy currents from flowing between the shield cup electrode and the electron lens forming electrode.

The fourth method is to provide an in-line type color Braun tube according to the tube provided by the first method, wherein a side wall of the electron lens forming electrode adjacent the shield cup electrode is separated into at least two parts in the beam passing direction so that a gap is provided between the separated two parts of the side wall of the electron lens forming electrode which prevents eddy currents from flowing between the separated two parts.

The fifth method is to provide an in-line type color Braun tube having a shield cup electrode which is open at the side facing the fluorescent screen surface of the tube and is provided at the end of an electron gun, wherein the shield cup electrode comprises a cylindrical side wall for shielding the three electron beams generated by the electron gun from influences of an electrostatic charge accumulated at a wall surface of the glass bulb of the tube, a base plate having three beam passing holes aligned in a horizontal direction, and two pairs of projecting plates, provided by bending a pair of rectangular parts projecting from a base member made of non-magnetic and conductive material, so as to extend perpendicularly from the base member attached at the surface of the base plate of the shield cup electrode facing the fluorescent screen, in parallel to each other, a respective pair of projecting plates being disposed at the upper and lower places of each of the side holes of the three beam passing holes, the base member with the two pairs of bent projecting plates being welded to the base plate at places outside both side holes.

By using the first method, the effect of the horizontal deflection field is equally applied to each of the beams aligned in the horizontal direction, by receiving the influences of the magnetic field generated by eddy currents induced in the cylinders made of non-magnetic and conductive material at both side beam passing holes. Thus, even with a high frequency deflection field, any misconvergence due to eddy currents induced in the side wall of the shield cup electrode or the electron lens forming electrode can be suppressed to a negligible level. Further, the paths of the beams can be secured by the second method, since the cylinders are placed so as to project in a direction perpendicular to the base of the shield cup electrode.

By using the third method, since the gap between the shield cup electrode and the electron lens forming electrode prevents eddy currents induced by the deflection field from flowing between the shield cup electrode and the electron lens forming electrode, any misconvergence due to eddy currents induced in the side wall of the shield cup electrode or the electron lens forming electrode can be suppressed to a negligible level, even with a high frequency deflection field.

Further, by using the fourth method, since the gap between the separated two parts of the side wall of the electron lens forming electrode prevents eddy currents induced by the deflection field from flowing between the separated two parts, any misconvergence due to eddy currents induced in the side wall of the shield cup electrode or the electron lens forming electrode can be suppressed to a negligible level.

Furthermore, by using the fifth method, since the manner in which eddy currents flow between the base plate of the shield cup electrode and the bent projecting plates is improved by setting the welding points outside both side holes of the three beam passing holes, in comparison with the flow generated by setting the welding points inside the both side holes, any misconvergence due to eddy currents flowing in the side wall of the shield cup electrode or the electron lens forming electrode can be suppressed to a negligible level, even with a high frequency deflection field.

DETAILED DESCRIPTION OF THE EMBODIMENTS

Figure 1A:
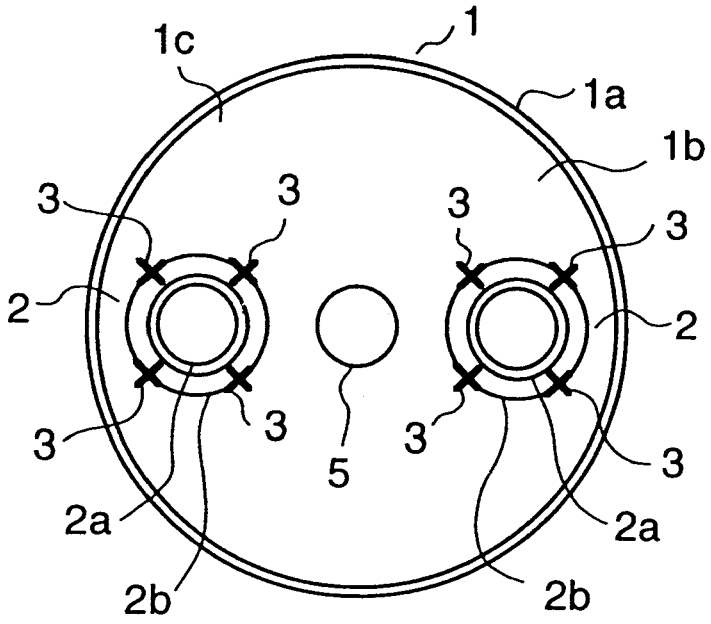
FIG. 1A is a plan view of a shield cup electrode for use in a first embodiment of the present invention.

Hereinafter, details of the present invention will be explained with reference to various embodiments shown in the drawings.

Figure 1B:
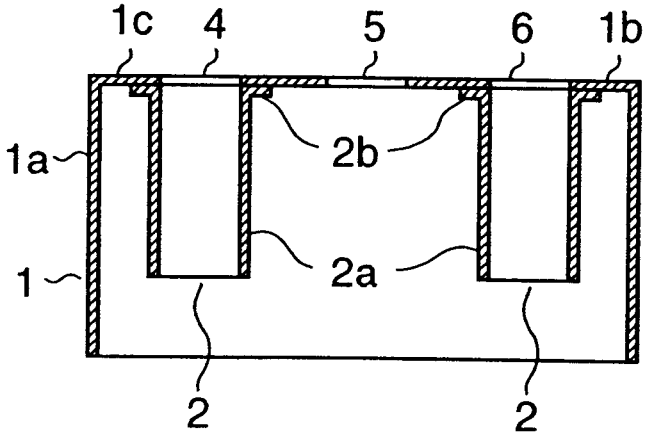
FIG. 1B is a cross sectional view at the horizontal center line of the shield cup electrode in FIG. 1A.

The first embodiment:

FIG. 1A and 1B are a plan view and a cross sectional view at the horizontal center line, respectively, of a shield cup electrode for use in the first embodiment of the present invention. In the following explanation, the same reference numerals are used to identify parts equivalent to the parts of a previously described example, and repeated descriptions of those parts are omitted.

In FIGS. 1A and 1B, a shield cup electrode 1 has a disk shaped base plate 1*c* and a side wall 1*a* projecting from the edge of the base plate 1*c* (also referred to as a side shield wall), and an inner base surface 1*b* of the base plate 1*c* and the side shield wall 1*a* forms a cup shaped space. At the base plate 1*c*, three beam passing holes 4, 5 and 6 are provided, these holes being aligned in the horizontal direction, as typically provided in an in-line arrangement, and a pair of cylinders 2, made of non-magnetic and conductive material, such as stainless steel, for suppressing eddy currents, are attached to a peripheral part on the inner base surface 1*b* around each of the side holes 4 and 6, so as to extend in a direction perpendicular to the inner base surface 1*b*. By means of the cylinders 2, cylindrical walls 2*a* are formed so that each of the cylindrical walls 2*a* surrounds one of the paths of the beams passing through the side beam passing holes 4 and 6 and acts as a member for suppressing eddy currents induced in the shield cup electrode. The end surface part of each of the cylinders 2 adjacent the inner base surface 1*b* is integrated with a flange shaped bending member 2*b* by which it is attached to the inner base surface 1*b* of the base plate 1*c* at welding points 3 indicated by an x mark. The length (projecting length) of each of the cylinders 2 is set to be shorter than the length of the side wall of the shield cup electrode 1.

Figure 2:
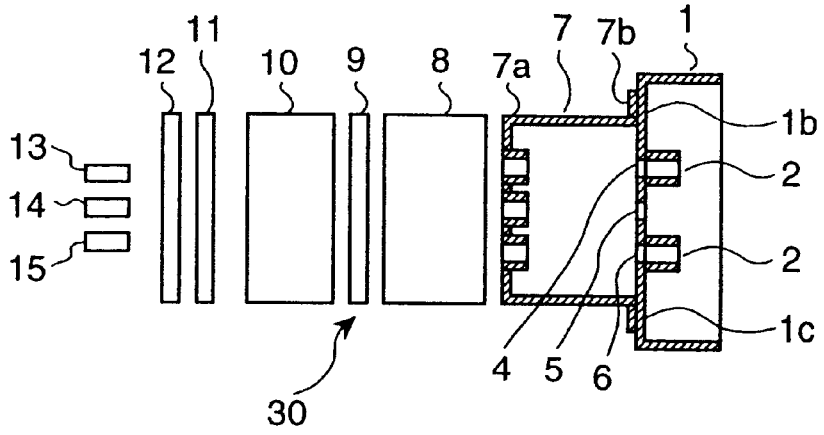
FIG. 2 is a diagram which shows an outline of the structure of an electron gun forming a first embodiment of the present invention.

FIG. 2 shows an outline of the structure of an electron gun employing the shield cup electrode of FIG. 1A. As shown in FIG. 2, electrodes of a plurality of electron guns are arranged in series at the side opposite the projecting direction of the cylinders 2 attached to the inner base surface 1*b* of the shield cup electrode 1, namely, at the side of the shield cup electrode opposite to the shadow-mask and screen of the CRT. Those electrodes are a G6 electrode 7, a G5 electrode 8, a G4 electrode 9, a G3 electrode 10, a G2 electrode 11 and a G1 electrode 12, arranged in order from the shield cup electrode 1 to the elements 13, 14 and 15, which are cathodes for emitting the three beams. A side wall 7*a* of the G6 electrode 7 is attached perpendicularly to the base plate 1*c* of the shield cup electrode 1 by way of a bending member 7*b* integrated to the G6 electrode 7. As the non-magnetic and conductive material used for the cylinders 2 for suppressing eddy currents, a material besides a metal, for example, a ceramics material, is available.

Figure 3:
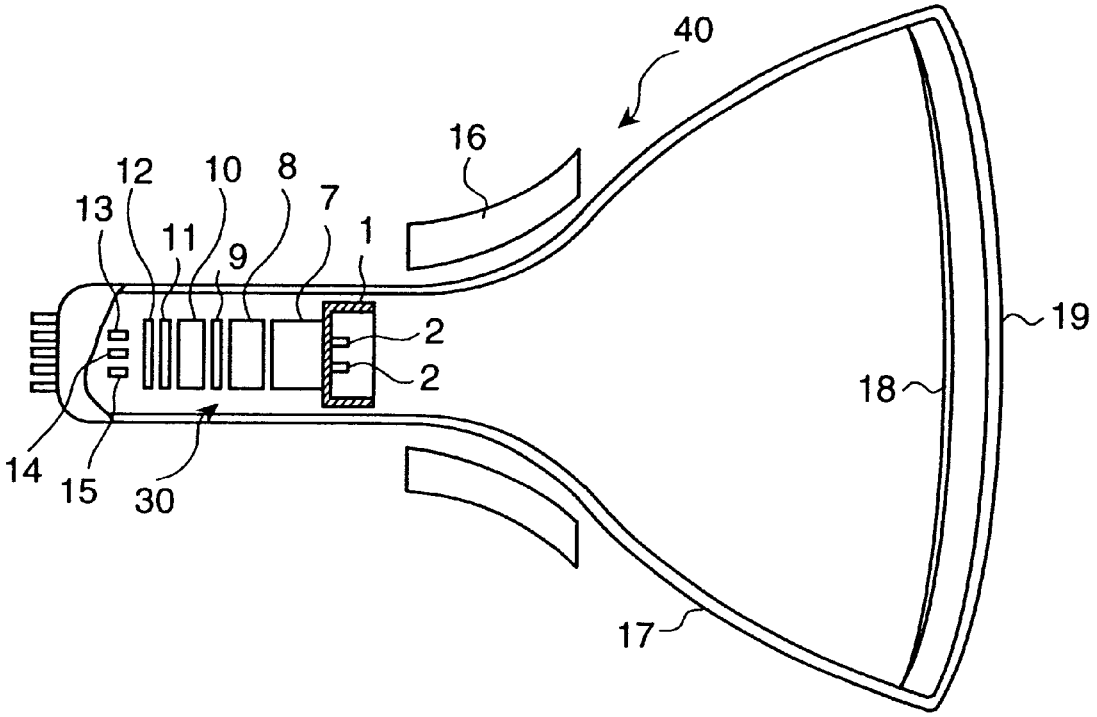
FIG. 3 is a diagram which shows an outline of the structure of a color Braun tube including the electron gun shown in FIG. 2 provided with the shield cup electrode shown in FIGS. 1A and 1B.

FIG. 3 shows an outline of the structure of a color Braun tube 40 including a electron gun 30 provided with the shield cup electrode 1 having the cylinders 2 for suppressing eddy currents. The color Braun tube 40 is composed of the electron gun 30, including the shield cup electrode 1 having the cylinders 2, a G6 electrode 7, a G5 electrode 8, a G4 electrode 9, a G3 electrode 10, a G2 electrode 11, a G1 electrode 12, and the cathodes 13, 14 and 15 for emitting the electron beams, an outside deflection yoke 16, a glass bulb 17 forming a tube wall, a shadow mask 18 arranged between the fluorescent surface and the shield cup electrode 1 and near the fluorescent surface, and a screen 19 (the fluorescent surface) positioned at the front of the tube.

In order to confirm the effects of the color Braun tube 40 having the above-mentioned structure according this embodiment, the misconvergence amounts have been measured for the color Braun tube of the invention and the prior art tube disclosed in JP-A-190232/1988, and the measured results are shown in Table 1.

Figure 4A:
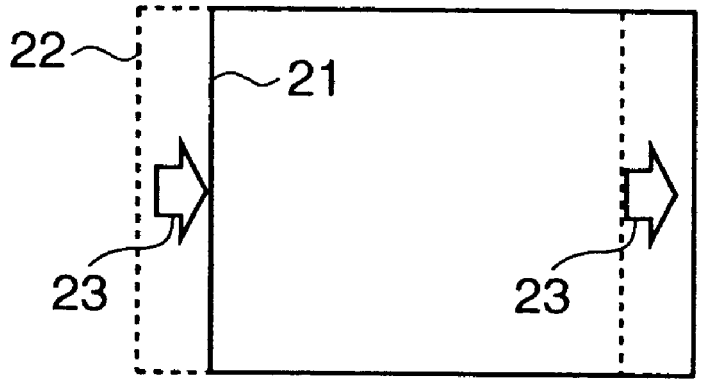
FIG. 4A is a diagram for explaining a right biased aberration amount relating to a green spot, with respect to red and blue spots (RAGRB), which is one of the parameters indicating the misconvergence amounts of the three electron beams.
Figure 4B:
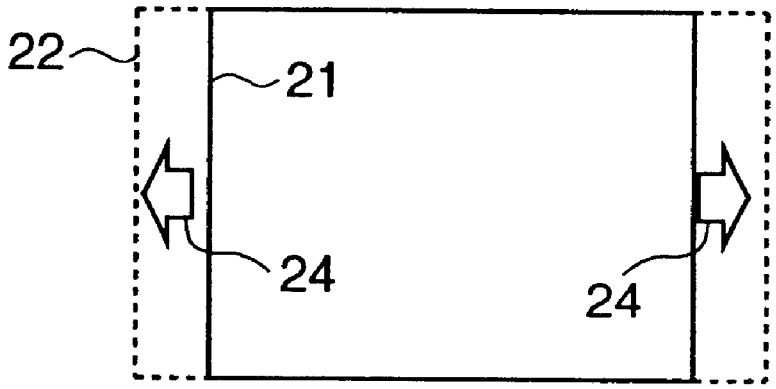
FIG. 4B is a diagram for explaining a widening aberration amount of the red and blue spots with respect to a green spot (WAORB), which is one of the parameters indicating the misconvergence amounts of the three electron beams.

The heights of the side wall and the bent projecting plates 20*a* of the shield cup electrode 1 in the prior art tube are set to 8 mm and 5.7 mm, respectively. On the other hand, the heights of the side wall and the cylinders 2 for suppressing eddy currents of the shield cup electrode 1 in the tube of the invention are set to 8 mm and 4.0 mm, respectively. In determining the misconvergence amounts, the following two parameters were measured, that is, a right biased aberration amount relating to a green spot, with respect to the red and blue spots (hereafter abbreviated to RAGRB), and a widening aberration amount of the red and blue spots with respect to a green spot (hereafter abbreviated to WAORB). In FIGS. 4A and 4B, the parameters RAGRB and WAORB are conceptually illustrated, respectively. In FIG. 4A, numeral 21 indicates a rectangular green spot displayed on the screen of the tube 40 by the beam for the green color, and numeral 22 indicates the center line of a rectangular region formed by an aberration between a rectangular red spot displayed by the beam for the red color and a rectangular blue spot displayed by the beam for the blue color. An arrow 23 indicates the parameter RAGRB expressing a one-direction biased aberration between each side line of the rectangular green spot, and the center line of the rectangular region formed by an aberration between the rectangular red spot and the rectangular blue spot. An arrow mark 24 in FIG. 4B indicates the parameter WAORB expressing a widening amount of the two center lines existing at both sides of the rectangular green spot. The results measured for the two frequency conditions of the deflecting field are shown for the above-mentioned two aberration parameters, where the shown values are relative values.

TABLE 1

| | 31 kHz→64 kHz | | | 31 kHz→82 kHz | | |
|---|---|---|---|---|---|---|
| | A | B | A + B | C | D | C + D |
| Prior Art tube (8 mm + 5.7 mm) | 0.50 | 0.50 | 1.00 | 0.60 | 0.50 | 1.10 |
| Present tube (8 mm + 4 mm) | 0.30 | 0.20 | 0.60 | 0.50 | 0.10 | 0.40 |

As shown in Table 1, although the 4 mm height of the cylinders 2 of the shield cup electrode 1 in the tube of the invention is lower than the 5.7 mm height of the bent projecting plates 20*a*, the sum of RAGRB and WAORB for the tube of the invention is smaller than the corresponding sum for the prior art tube. Therefore, it has been proven that the tube of the invention can more effectively suppress misconvergence than the prior art tube, for a high frequency deflection field change. Thus, the measured results show that the structure of the shield cup electrode 1 of this embodiment is very effective, and further that the cylinders 2 can downsized even more.

Figure 5:
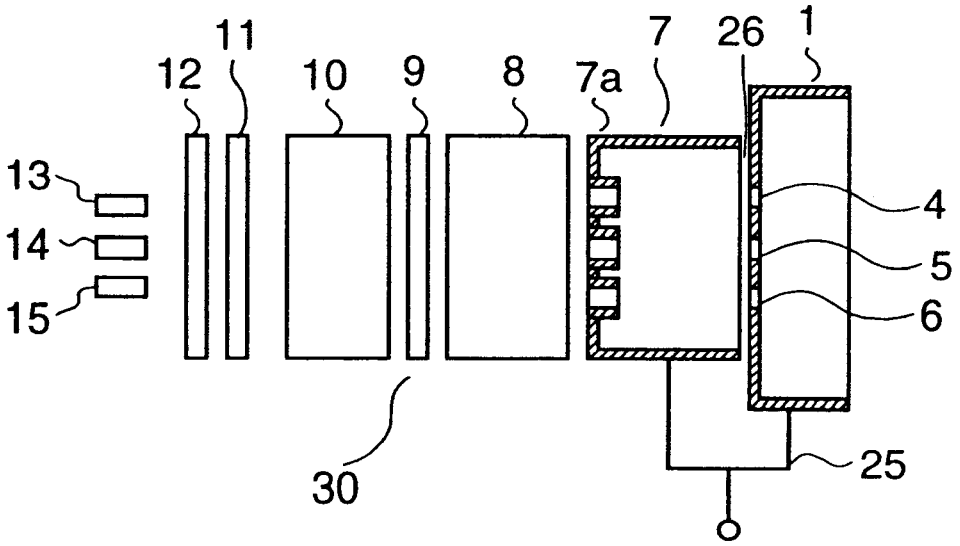
FIG. 5 is a diagram which shows an outline of the structure of an electron gun representing a second embodiment of the present invention.

The second embodiment:

FIG. 5 shows an outline of the structure of an electron gun in forming a second embodiment of the invention. As shown in the figure, a gap 26 is provided between the shield cup electrode 1 and the G6 electrode 7 of the electron lens adjacent the shield cup electrode 1, and the shield cup electrode 1 and the G6 electrode 7 are electrically connected so that both electrodes have an equal potential. In this embodiment, unlike the first embodiment, a cylinder for suppressing eddy currents is not provided on the shield cup electrode 1. In the following explanation of this embodiment, the same reference numerals are used to denote parts equivalent to parts of the first embodiment, and a further explanation of those parts is omitted.

By using the above-mentioned structure of the electron gun of this embodiment, since the gap 26 prevents eddy currents from flowing between the shield cup electrode 1 and the G6 electrode 7, any misconvergence due to eddy currents can be suppressed to a practically negligible level, even with a high frequency deflecting field.

Figure 6:
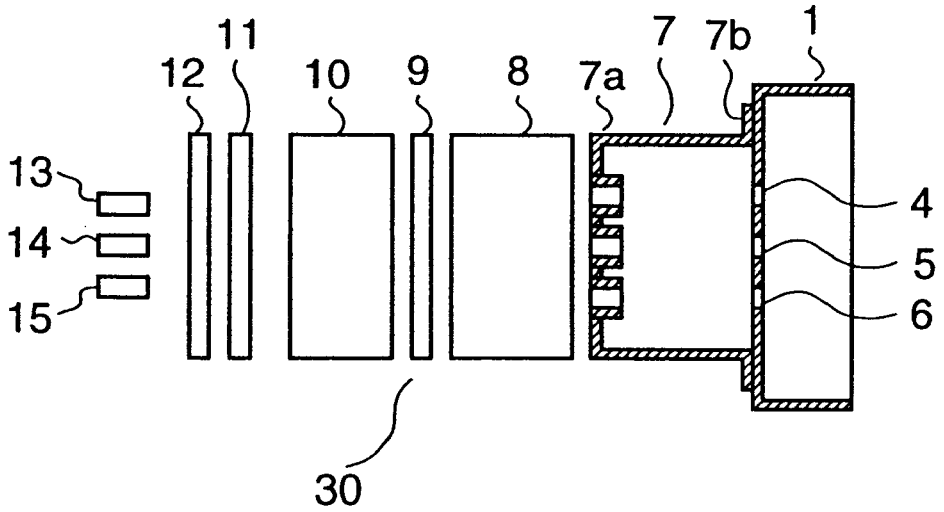
FIG. 6 is a diagram which shows an outline of the structure of an electron gun to be compared with the electron gun of FIG. 5.

In order to confirm that the color Braun tube of the second embodiment can suppress a misconvergence due to eddy currents to a negligible level, for a high frequency deflecting field, misconvergence due to eddy currents are numerically analyzed for the color Braun tube using an electron gun with the gap 26, as shown in FIG. 5, and a tube using an electron gun without a gap 26, as shown in FIG. 6, respectively. The results of the numerical analysis show that the misconvergence amount of the tube using the electron gun shown in FIG. 5 is about 10% of the misconvergence amount of the tube using the electron gun shown in FIG. 6. Thus, the effectiveness of the second embodiment was also confirmed.

Figure 7:
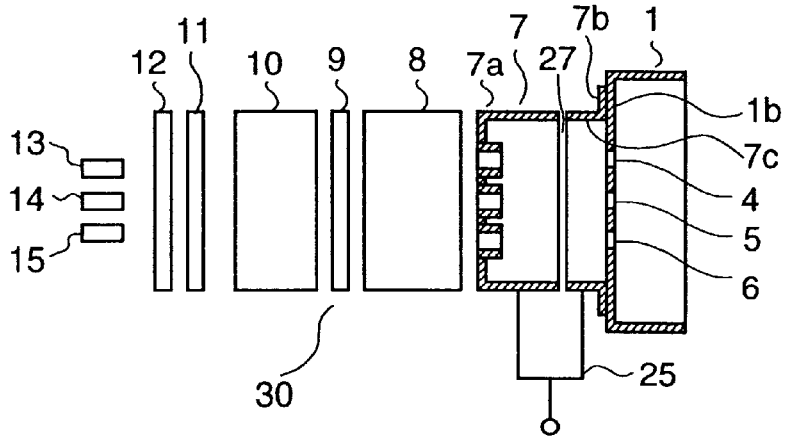
FIG. 7 is a diagram which shows an outline of the structure of an electron gun forming a third embodiment of the present invention.

The third embodiment:

FIG. 7 shows an outline of the structure of an electron gun of a color Braun tube representing a third embodiment of the present invention. As shown in the figure, the side wall of G6 electrode 7 adjacent the shield cup electrode 1 is divided into two parts at side walls 7*a* and 7*c*, and a gap 27 is provided between the walls 7*a* and 7*c*. A bending member 7*b* is formed by bending a part near to the end surface of the side wall 7*c*, facing the base plate 1*c* of the shield cup electrode 1. The bending member 7*b* is welded to the base plate 1*c* of the shield cup electrode 1. Further, the side wall 7*a* and the side wall 7*c* are electrically connected with a connection wire so that both separated side walls 7*a* and 7*c* have an equal potential. Also, in this embodiment, like the second embodiment, a cylinder 2 for suppressing eddy currents is not provided in the shield cup electrode 1. In the following explanation of this embodiment, the same reference numerals are used to identify parts equivalent to the parts of the first embodiment, and an explanation of those parts is omitted.

By using the above-mentioned structure of the electron gun of this embodiment, since the gap 27 between the side walls 7*a* and 7*c* prevents eddy currents from flowing between the shield cup electrode 1 and the side wall 7*a* of the G6 electrode 7, any misconvergence due to eddy currents can be suppressed to a practically negligible level, even with a high frequency deflecting field. Since the side wall 7*c* of the G6 electrode 7 is welded to the shield cup electrode, that is, since they are electrically connected to each other, they have an equal potential.

Figure 8:
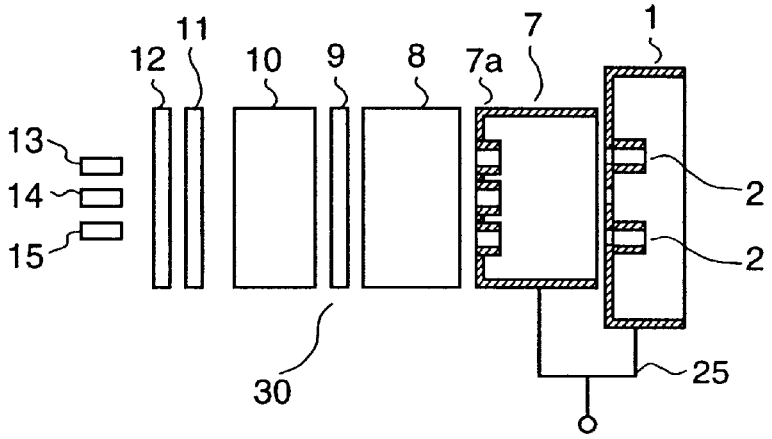
FIG. 8 is a diagram which shows an outline of the structure of an electron gun forming a fourth embodiment of the present invention.

The fourth embodiment:

In FIG. 8 shows an outline of the structure of an electron gun of a color Braun tube representing a fourth embodiment of the present invention. As shown in the figure, the cylinders 2 for suppressing eddy currents are perpendicularly attached to both side beam passing holes 4 and 6 of the shield cup electrode 1, and a gap 26 is provided between the shield cup electrode 1 and the G6 electrode 7 of the electron lens adjacent the shield cup electrode 1. Further, the shield cup electrode 1 and the G6 electrode 7 are electrically connected so that both electrodes have an equal potential.

By using the above-mentioned structure of the electron gun of this embodiment, the color Braun tube of this embodiment has the combined effects of both the first and second embodiments.

Figure 9:
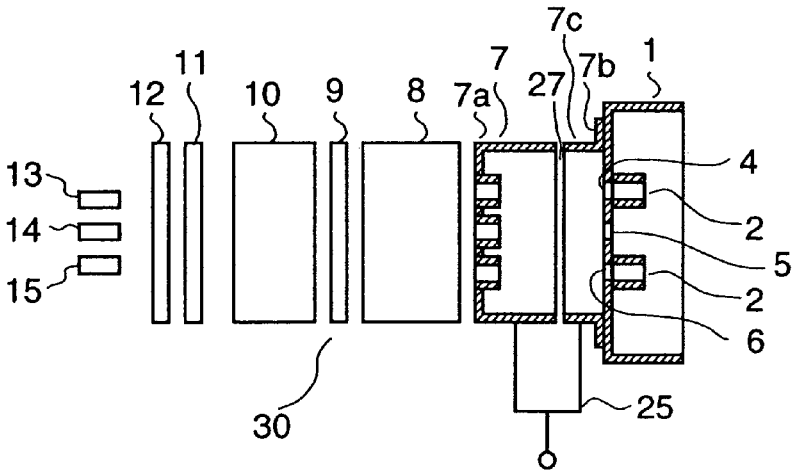
FIG. 9 is a diagram which shows an outline of the structure of an electron gun forming a fifth embodiment of the present invention.

The fifth embodiment:

FIG. 9 shows an outline of the structure of an electron gun of a color Braun tube representing a fifth embodiment of the present invention. As shown in the figure, the cylinders 2 for suppressing eddy currents are perpendicularly attached to both side beam passing holes 4 and 6 of the shield cup electrode 1, and the G6 electrode 7 adjacent the shield cup electrode 1 is divided into two parts at side walls 7*a* and 7*c*, and a gap 27 is provided between the walls 7*a* and 7*c*. A bending member 7*b* is formed by bending a part near to the end surface of the side wall 7*c*, facing the base plate 1*c* of the shield cup electrode 1. The bending member 7*b* is welded to the base plate 1*c* of the shield cup electrode 1. Further, the side wall 7*a* and the side wall 7*c* are electrically connected with a connection wire so that the both side walls have an equal potential.

By using the above-mentioned structure of the electron gun of this embodiment, the color Braun tube of this embodiment has the combined effects of both the first and third embodiments.

Figure 10A:
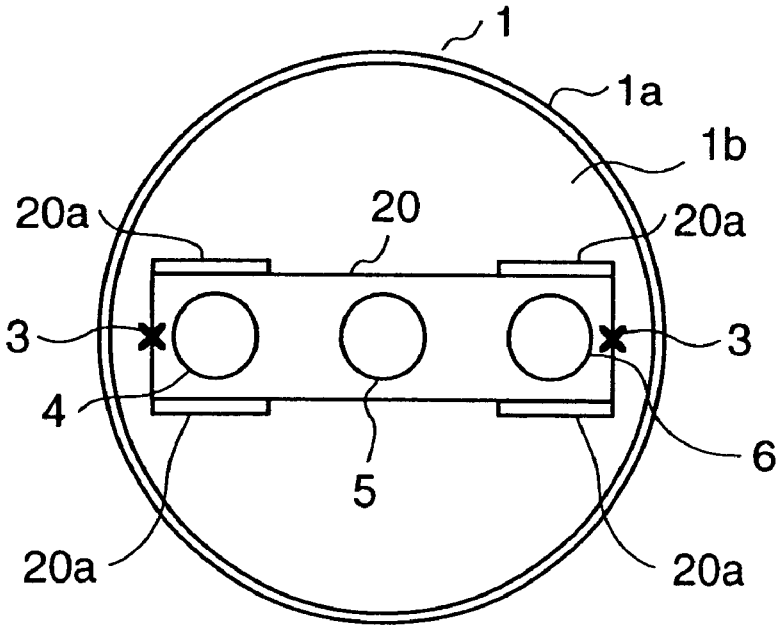
FIG. 10A is a plan view of a shield cup electrode for use in a sixth embodiment of the present invention.
Figure 10B:
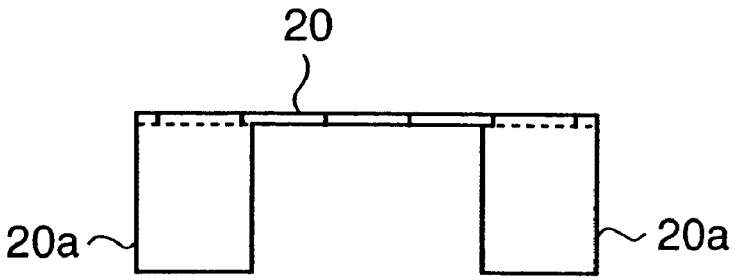
FIG. 10B is a cross sectional view at the horizontal center line of the shield cup electrode of FIG. 10A.

The sixth embodiment:

FIGS. 10A and 10B are a plan view and a cross sectional view at the horizontal central line, respectively, of a shield cup electrode as used in a sixth embodiment of the present invention. In this embodiment, the welding points 3, indicated by an x mark, are set at two points, each of the points being set within the area of respective one of said two pairs of bent projecting plates, and more particularly outside both side beam passing holes 4 and 6 in this embodiment. Other than the location of the welding points 3, the shield cup electrode 1 is the same as the shield cup electrode 1 of the prior art tube shown in FIGS. 11A and 11*b*. Therefore, further explanation of these same parts is omitted.

Figure 11A:
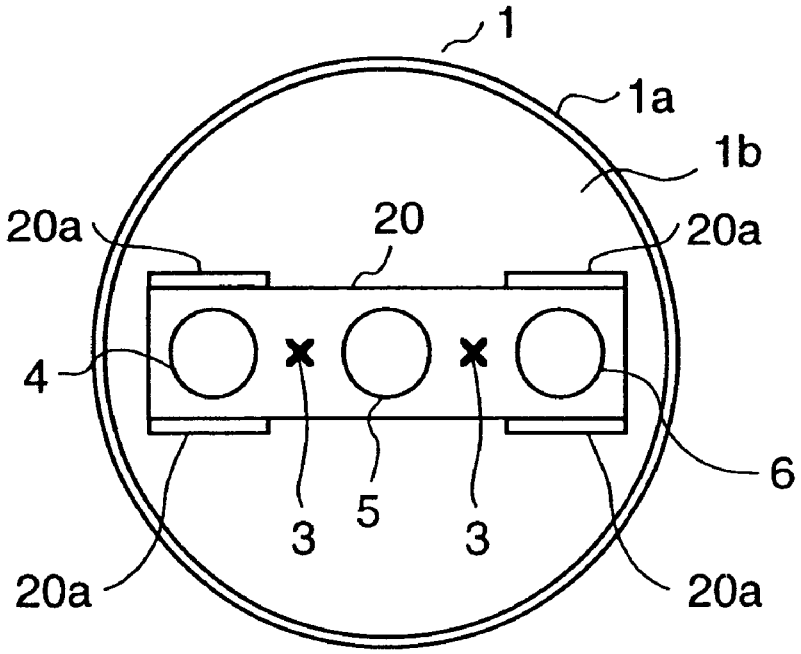
FIG. 11A (PRIOR ART)
FIG. 11A is a plan view of a shield cup electrode as used in the prior art.
Figure 11B:
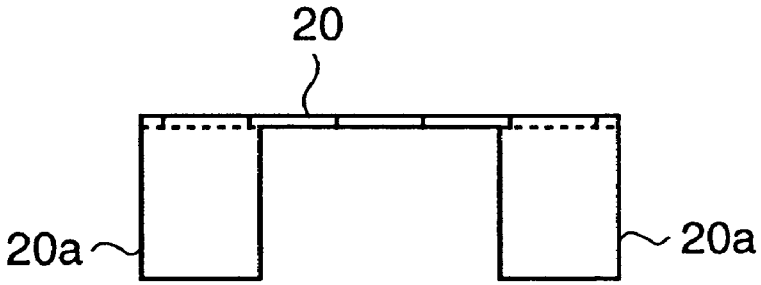
FIG. 11B (PRIOR ART)
FIG. 11B is a cross sectional view at the horizontal central line of the shield cup electrode of FIG. 11A.
Figure 13:
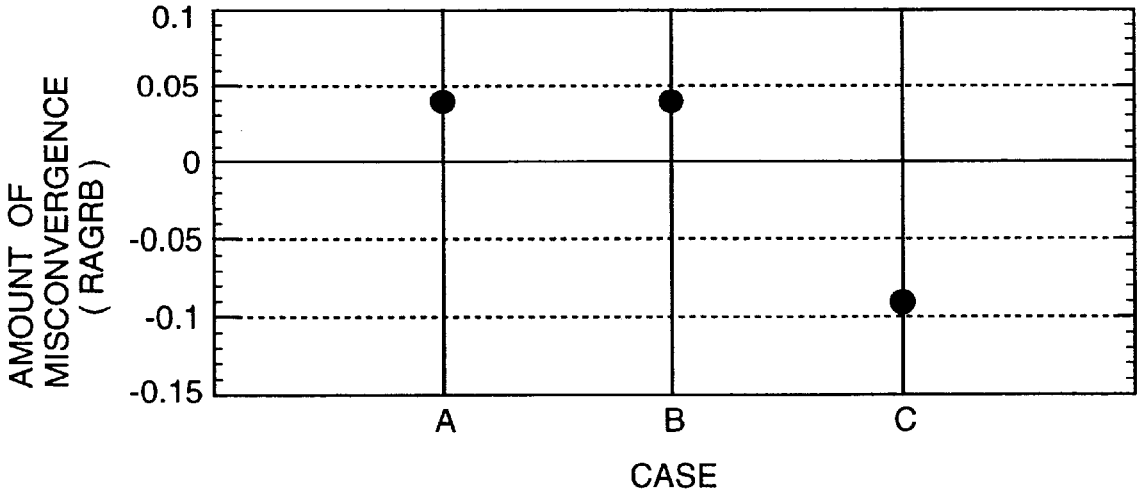
FIG. 13 is a chart which shows the measured misconvergence parameters for each of the cases A, B and C.

The misconvergence amounts were measured for the shield cup electrode 1 of this embodiment in which the welding points 3 are set at the places outside both side beam passing holes 4 and 6, and the shield cup electrode 1 of the prior art tube, shown in FIGS. 11A and 11*b*, in which the welding points 3 are set between the holes 4 and 5 and between the holes 5 and 6, and in an area sandwiched between the plate of the two pairs of bent projecting plates 20*a*, respectively, and the measured results are shown in FIG. 13.

Figure 12A:
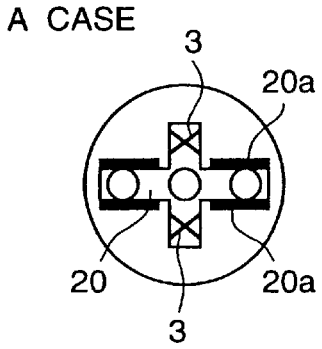
FIGS. 12A and 12B are plan views of shield cup electrodes of a case A and a case B, respectively, to be compared with the shield cup electrode of FIG. 10A.
Figure 12B:
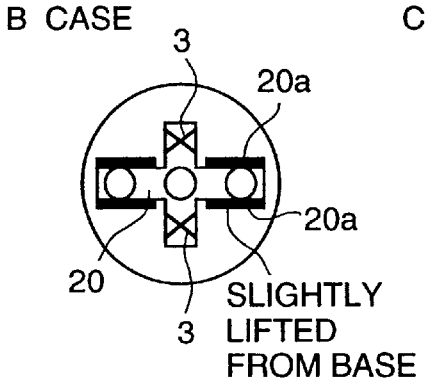
Figure 12C:
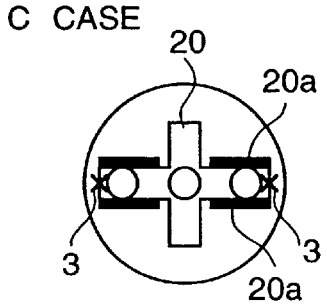
FIG. 12C is a plan view of the shield cup electrode of FIG. 10A forming a case C.

In the case A, shown in FIG. 12A, the welding points 3 were set at positions inside both side holes 4 and 6, like the shield cup electrode 1 of the prior art tube. On the other hand, in case B shown in FIG. 12B, although the welding points were also set at positions inside both side holes 4 and 6, both side parts of the base member, each of the parts being between the plates of each pair of bent projecting plates 20*a*, are slightly lifted from the surface 1*b* of the base plate 1*c* of the shield cup electrode 1. An object of testing case B was to examine the effects of the contacts between the base member 20 and the surface 1*b* at both sides of the base member 20. In case C shown in FIG. 12C, the welding points 3 are set at positions outside both side holes 4 and 5, like the embodiment shown in FIGS. 10A and 10B. In the three tested cases, the height of the bent projecting plates 20*a* of the base member 20 was set to the same height.

As shown in FIG. 13, although the misconvergence amounts for cases A and B are positive, the misconvergence amount for case C is negative, which means that the misconvergence amount can be adjusted to about zero by decreasing the height of the pairs of bent projecting plates, namely, the parallel plates 20*a* for suppressing eddy currents, by an amount corresponding to the negative misconvergence amount. Further, it is possible to decrease the misconvergence and downsize the electron gun by adopting the positioning of the welding points 3 as mentioned in connection with FIGS. 10A and 10B.

As seen from the above explanation of the present invention, by using the present invention, it is possible to suppress any misconvergence of the beams in a color Braun tube with an in-line type electron gun to a practically negligible level, which makes it possible to provide a color Braun tube having a high definition performance.

Furthermore, since it is possible to downsize the structure, namely, the cylinders or the projecting parallel plates, for suppressing eddy currents, the shield cup electrode also can be downsized, which naturally downsizes the electron gun.

What is claimed is:

1. An in-line type color Braun tube comprising a fluorescent screen and a shield cup at an end of an electron gun, said shield cup including a cylindrical side wall and a bottom having a center electron beam passing hole and two side electron beam passing holes aligned in a horizontal direction, and a convergence correcting member including a base and a pair of horizontal plates, said base and horizontal plates being a one piece member, and a bottom member of said base being cross-shaped and including two side electron beam passing holes and a center electron beam passing hole, said pair of horizontal plates sandwiching an electron beam passing through each of said side electron beam passing holes, in a direction vertical to said electron beam, said base being spot-welded to said bottom of said shield cup at an outer side of each of said side electron bottom beam passing holes proximate to a periphery of said bottom of said shield cup.

2. An in-line type color Braun tube according to claim 1, wherein said horizontal plates and base are made of non-magnetic materials.

3. An in-line type color Braun tube according to claim 1, wherein a horizontal deflecting frequency is at least equal to 64 kHz.

4. An in-line type color Braun tube according to claim 1, wherein a horizontal deflecting frequency is at least equal to 82 kHz.

5. An in-line type color Braun tube comprising a fluorescent screen and a shield cup at an end of an electron gun, said shield cup including a cylindrical side wall and a bottom having a center electron beam passing hole and two side electron beam passing holes aligned in a horizontal direction, and a convergence correcting member includes a base and a pair of horizontal plates, said base and horizontal plates being a one piece member, and a bottom member of said base being cross-shaped and including two side electron beam passing holes and a center electron beam passing hole, said pair of horizontal plates sandwiching an electron beam passing through each of said side electron beam passing holes of said bottom member, in a direction vertical to said electron beam, a branch of said cross-shaped bottom member extending outside from said center electron beam passing hole toward a periphery of said shield cup in both directions perpendicular to said horizontal direction in which said two side electron beam passing holes and said center electron beam passing hole of said bottom of said shield cup are aligned, and said base being spot-welded to said bottom of said shield cup at both outer sides of said center hole, in said branch of said cross-shaped bottom member.

6. An in-line type color Braun tube according to claim 5, wherein said horizontal plates and base are made of non-magnetic materials.

7. An in-line type color Braun tube according to claim 5, wherein a horizontal deflecting frequency is at least equal to 64 kHz.

8. An in-line type color Braun tube according to claim 5, wherein a horizontal deflecting frequency is at least equal to 82 kHz.

* * * * *